US005842855A

United States Patent [19]

Nakamura

[11] Patent Number: 5,842,855

[45] Date of Patent: Dec. 1, 1998

[54] SEALING APPARATUS FOR INLET/OUTLET OF COMPARTMENT OF CONTINUOUS HEAT TREATMENT FURNACE, CONTINUOUS VACUUM EVAPORATION FACILITY OR THE LIKE

[75] Inventor: Teruhisa Nakamura, Shinnanyo, Japan

[73] Assignee: Nisshin Steel Co., Ltd., Tokyo, Japan

[21] Appl. No.: 727,476

[22] PCT Filed: Jun. 7, 1995

[86] PCT No.: PCT/JP95/01146

§ 371 Date: Oct. 16, 1996

§ 102(e) Date: Oct. 16, 1996

[87] PCT Pub. No.: WO96/25524

PCT Pub. Date: Aug. 22, 1996

[30] Foreign Application Priority Data

Feb. 16, 1995 [JP] Japan ..... 7-028434

[51] Int. Cl.[6] ..... F27D 1/18; F26B 25/20

[52] U.S. Cl. ..... 432/242; 34/242

[58] Field of Search ..... 432/242; 34/406, 34/414, 417, 242; 266/183, 102, 110

[56] References Cited

U.S. PATENT DOCUMENTS

| | | | |
|---|---|---|---|
| 2,929,614 | 3/1960 | Young et al. . | |
| 3,291,468 | 12/1966 | Albertsen et al. . | |
| 4,168,823 | 9/1979 | Buder et al. | 34/242 |
| 4,184,346 | 1/1980 | Sando et al. | 34/242 |
| 5,683,651 | 11/1997 | Nakamura | 266/110 |
| 5,685,088 | 11/1997 | Nakamura | 432/242 |
| 5,693,288 | 12/1997 | Nakamura | 432/242 |

FOREIGN PATENT DOCUMENTS

| | | |
|---|---|---|
| 0 685 696 | 6/1995 | European Pat. Off. . |
| 42-18893 | 9/1942 | Japan . |
| 62-214134 | 9/1987 | Japan . |
| 62-287020 | 12/1987 | Japan . |
| 3-253518 | 11/1991 | Japan . |
| 5-214450 | 8/1993 | Japan . |
| 6-45875 | 6/1994 | Japan . |

OTHER PUBLICATIONS

Patent Abstracts of Japan, vol. 013, No. 399 (C–632), 5 Sep. 1989 & JP–A–01 142082 (Mitsubishi Heavy Ind. Ltd.; Others: 01), 2 Jun. 1989, *abstract*.

*Primary Examiner*—Henry A. Bennett
*Assistant Examiner*—Gregory A. Wilson
*Attorney, Agent, or Firm*—Wenderoth, Lind & Ponack, L.L.P.

[57] ABSTRACT

The invention provides a sealing apparatus hardly causing a fire and capable of ensuring a stable sealing performance over a long time is obtained. The sealing apparatus is provided at an inlet/outlet for a metal strip 22 in a bright annealing furnace 21 to shut off atmospheric gas in the furnace from the outside air. A pair of elastic rolls 30*a*, 30*b* push both sides of the metal strip 22. The boundaries between the elastic rolls 30*a*, 30*b* and pushing members 25*a*, 25*b* are hermetically sealed by rigid rolls 26*a*, 26*b*. The elastic rolls 30*a*, 30*b* and the pushing members 25*a*, 25*b* are made of an elastic material, and the rigid rolls 26*a*, 26*b* are made of a metal. Nonwoven fabrics 27*a*, 27*b* are interposed between the rigid rolls 26*a*, 26*b* and the pushing members 25*a*, 25*b*.

21 Claims, 12 Drawing Sheets

SEALING APPARATUS FOR INLET/OUTLET OF COMPARTMENT OF CONTINUOUS HEAT TREATMENT FURNACE, CONTINUOUS VACUUM EVAPORATION FACILITY OR THE LIKE

FIELD OF THE INVENTION

The present invention relates to a sealing apparatus for sealing inlets/outlets of continuous heat treatment furnaces which use an atmospheric gas, such as a bright annealing furnace for metal strips, or inlets/outlets of continuous vacuum evaporation facilities for performing vacuum evaporation under reduced pressure, or for sealing inlets/outlets of compartments in such a facility.

DESCRIPTION OF THE RELATED ART

Conventionally, in continuous vacuum evaporation facilities or the like, such as a continuous atmospheric heat treatment apparatus disclosed in Japanese Examined Patent Publication JP(B2) 42-18893 (1967), or such as a continuous vacuum evaporation plating apparatus for steel strips disclosed in Japanese Examined Patent Publication JP(B2) 6-45875 (1994), sealing apparatuses have been used at the inlets/outlets of such facilities or the inlets/outlets of compartments of such facilities. Among such sealing apparatuses, a typical prior art for a continuous atmospheric heat treatment apparatus, in particular, a bright annealing furnace, is shown in FIGS. 13 and 14.

Referring to FIG. 13, a metal strip 2 such as a stainless steel strip, is continuously passed through a vertical bright annealing furnace 1, and the metal strip 2 is annealed in a bright condition. The interior of the bright annealing furnace 1 is maintained in a flammable reducing atmosphere including hydrogen gas, such as a mixture gas essentially consisting of 75% of hydrogen gas and 25% of nitrogen gas or an ammonia dissociated gas, to prevent the metal strip 2 from being oxidized. The metal strip 2 is supplied from a payoff reel or the like provided on the upstream side, and the passing direction of the metal strip 2 is changed by a deflector roll 3. The metal strip 2 is introduced into the bright annealing furnace 1 via a sealing apparatus 4 on the inlet side of the furnace 1. Inside the bright annealing furnace 1, the metal strip 2 is heated and annealed by the down-heat method while the metal strip 2 is lowered. The annealed metal strip 2 is delivered to a deflector roll 6 via a sealing apparatus 5 on the outlet side of the furnace 1, and the passing direction of the metal strip 2 is changed by the deflector roll 6, and the metal strip 2 is taken up.

FIG. 14 shows the structure of the sealing apparatus 5 on the outlet side shown in FIG. 13. The structure of the sealing apparatus 4 on the inlet side is substantially the same as that of the sealing apparatus 5. In the sealing apparatus 5, the base ends of seal pads 7*a*, 7*b* are hermetically secured to a furnace wall 8 at both ends of the metal strip 2 in the width direction thereof. A cylinder 9 exerts force so that a pair of seal rolls 10*a*, 10*b* push both sides of the metal strip 2. In addition, the seal rolls 10*a*, 10*b* are pushed by the seal pads 7*a*, 7*b*. The pushing forces are adjusted by pushing force adjustment devices 11*a*, 11*b*.

Such sealing apparatuses 4, 5 as shown in FIG. 13 are used to shut off a flammable atmospheric gas in the bright annealing furnace 1 from the outside air. Since it is very difficult to completely shut off the gas while allowing the metal strip 2 to pass through, the atmospheric pressure in the furnace is made higher by 10 to 50 mm $H_2O$ than the pressure of the outside air in actual practice so as to allow the atmospheric gas to leak gradually to the outside air. In case vapor or oxygen in the outside air enters the bright annealing furnace 1, the metal strip 2 is oxidized in the bright annealing furnace 1. This causes not only the problem of preventing bright annealing but also the danger of a serious disaster, such as a fire or an explosion. In addition, in case the bright annealing furnace 1 is damaged by a fire or the like and after the furnace 1 is repaired, it takes time to restore the dew point of the atmosphere in the furnace. During the time, bright heat treatment must be stopped. In this way, the performance of the sealing apparatus exerts a significant effect on the production activities of the bright annealing furnace. In the same way, in a vacuum evaporation facility or the like, the hermeticity of the sealing apparatus is important to maintain the interior of a compartment of such a facility at a positive pressure higher than atmospheric pressure just as in the case of the bright annealing furnace or to maintain the interior of the compartment under reduced pressure or vacuum so as to perform evaporation.

In such sealing apparatuses 4, 5 as shown in FIGS. 13 and 14, the seal pads 7*a*, 7*b* and the seal rolls 10*a*, 10*b* are made of elastic materials to enhance their sealing functions. The seal pads 7*a*, 7*b* are made of felt or nonwoven fabric equivalent to felt, for example, and the seal rolls 10*a*, 10*b* are made of rubber, for example. Since clearances are formed between the seal rolls 10*a*, 10*b* at both ends of the metal strip 2 in the width direction thereof because of the thickness of the metal strip 2, the gas in the furnace is apt to leak. To enhance the sealing performance, it is necessary to reduce the clearances by using soft rubber so as to allow the rubber to be deformed and enter the clearances having been formed. In this kind of sealing method using the combination of the seal pads 7*a*, 7*b* and the seal rolls 10*a*, 10*b*, the soft rubber is rubbed with the nonwoven fabric. When the pads firmly push the rolls, the surfaces of the elastic rolls may be scratched or the fibers of the nonwoven fabric may fall out from the seal pads 7*a*, 7*b*. In case the fibers attach to the metal strip, the fibers cannot be removed easily since the fibers are usually charged by static electricity. The fibers are pressed by rolling rolls in the next refining rolling process, thereby generating defects on the surfaces of the metal strip. To avoid these problems, the contact pressure between the seal pads 7*a*, 7*b* and the seal rolls 10*a*, 10*b* is apt to be lowered, thereby causing a phenomenon in which more amount of the atmospheric gas in the furnace leaks from the low contact pressure portions than from other portions. Furthermore, when the seal rolls 10*a*, 10*b* are pushed against the metal strip 2 passing through therebetween, the portions of the rolls usually contacting the sharp edges at both ends of the metal strip 2 in the width direction thereof are worn out intensively, and the gas in the furnace is apt to leak from the clearances between the worn portions and the metal strip 2. When a compartment of a vacuum evaporation facility or the like is under reduced pressure, the outside air is apt to enter the compartment from such leaky portions. In addition, just as in the case of the bright annealing furnace, in a compartment having a furnace pressure higher than those of other compartments, the atmospheric gas in the compartment is apt to leak to other compartments. These phenomena are completely the same as those in the case of the bright annealing furnace.

Furthermore, in the sealing apparatus 5 positioned at the lower portion of the vertical bright annealing furnace 1, refractory material pieces such as red-hot brick chips detached from the interior of the bright annealing furnace 1 or high-temperature broken pieces dropped from the metal strip 2 to be heat-treated directly fall and are apt to ignite the mixture gas of leaked atmospheric gas and air, thereby easily burning the seal pads 7*a*, 7*b* and the seal rolls 10*a*, 10*b*, and easily causing a fire. Besides, since friction is repeated between the seal pads 7*a*, 7*b* and the seal rolls 10*a*, 10*b*, static electricity is apt to generate, and spark discharge due to the static electricity is apt to ignite the mixture gas of the flammable atmospheric gas and air.

An object of the present invention is to provide a sealing apparatus for sealing a continuous heat treatment furnace, inlets/outlets of compartments of a continuous vacuum evaporation facility or the like, which is capable of enhancing the sealing performance at the inlets/outlets of heat treatment furnaces wherein an atmospheric gas including hydrogen gas is used or at the inlets/outlets of compartments of continuous vacuum evaporation facilities or the like having compartments wherein an atmospheric gas including hydrogen gas similar to the atmospheric gas in the heat treatment furnaces is used or having compartments being under vacuum or reduced pressure, thereby hardly causing a fire and ensuring a highly stable sealing performance over a long time.

DISCLOSURE OF THE INVENTION

The present invention discloses a sealing apparatus for sealing inlets/outlets of continuous heat treatment furnaces which use an atmospheric gas, continuous vacuum evaporation facilities which perform vacuum evaporation under reduced pressure, or the like, through which a metal strip is passed, or for sealing inlets/outlets of compartments of continuous heat treatment furnaces, continuous vacuum evaporation facilities or the like in which a pair of elastic rolls for sandwiching a metal strip is provided outward from an inlet and/outlet opening of a compartment, for passing the metal strip, to shut off the interior of the compartment from the exterior, the sealing apparatus comprising:

opposed side walls contacting the end faces of the pair of elastic rolls to ensure sealing;

a pair of rigid rolls hermetically contacting the pair of elastic rolls respectively with a clearance from the metal strip, between the opposed side walls; and elastic pushing members for hermetically sealing the boundary between each rigid roll and the furnace body or a compartment casing while contacting the rigid rolls.

The invention is characterized in that the atmospheric gas includes hydrogen gas.

The invention is characterized in that the sealing apparatus further comprises:

a pair of additional elastic rolls for sandwiching the metal strip, which are disposed outward away from the pair of elastic rolls between the opposed side walls, and a pair of intermediate rolls disposed between the elastic rolls and the additional elastic rolls with a clearance from the metal strip, between the opposed side walls, the pair of intermediate rolls hermetically contacting the elastic rolls and the additional elastic rolls.

The invention is characterized in that means for supplying the atmospheric gas for an atmospheric heat treatment furnace, a gas similar to the atmospheric gas, nitrogen gas or an inert gas is provided in a space formed by being surrounded by the elastic rolls, the additional elastic rolls and the intermediate rolls, between the opposed side walls.

The invention is characterized in that means for supplying the atmospheric gas for an atmospheric heat treatment furnace, a gas similar to the atmospheric gas, nitrogen gas or an inert gas is provided in a space formed by being surrounded by the elastic rolls, the additional elastic rolls and the intermediate rolls, between the opposed side walls and further an ion generator is installed in the space.

The invention is characterized in that a space formed by being surrounded by the elastic rolls, the additional elastic rolls and the intermediate rolls, between the opposed side walls is subjected to vacuum suction.

The invention is characterized in that the elastic rolls or the additional elastic rolls are made of an elastic body selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber, and hydrin rubber, leaving the specific electric resistance of the elastic body as it is, or providing the elastic body with electrical conductivity.

The invention is characterized in that the elastic rolls or the additional elastic rolls are integrally formed by cylindrically coating the over peripheral surfaces of metal shafts or metallic rolls with an elastic body selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber and hydrin rubber, in the longitudinal directions of the outer peripheral surfaces of metal shafts or metallic rolls, leaving the specific electric resistance of the elastic body as it is, or providing the elastic body with electrical conductivity; or the elastic rolls or the additional elastic rolls are integrally formed by mounting a cylindrical sleeve made of such elastic body on the outer peripheral surfaces of metal shafts or metallic rolls in the longitudinal directions thereof.

The invention is characterized in that the specific electric resistance of the elastic body of the elastic roll is in the range of 1 to $10^7$ Ω·cm.

The invention is characterized in that the hardness of the elastic body of the elastic roll is in the range of 40° to 90° specified in JIS K 6301 A.

The invention is characterized in that the elastic pushing members are made of an elastic body selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber and hydrin rubber, or a sponge-like elastic body having minute cells made by forming one kind of elastic body selected similarly, leaving the specific electric resistance of the selected elastic body as it is, or providing the selected elastic body with electrical conductivity to have a specific electric resistance in the range of 1 to $10^7$ Ω·cm.

The invention is characterized in that the elastic pushing member has a covering layer made of nonwoven fabric of 20 mm or less in thickness on the surface of the elastic body or the sponge-like elastic body.

The invention is characterized in that the nonwoven fabric of the elastic pushing member has a self-extinguishing characteristic at a limit oxygen index (LOI) value of 26 or more.

The invention is characterized in that the hardness of the elastic body or the sponge-like elastic body of the elastic pushing member of the invention is in the range of 10° to 50° specified in JIS S 6050.

The invention is characterized in that the electrical conductivity of the elastic body of the elastic roll and the elastic pushing member or the electrical conductivity of the sponge-like elastic body of the elastic pushing member is provided by mixing carbon.

The invention is characterized in that at both ends of the elastic roll in the axial direction thereof, elastic discs and slip discs are interposed between the end faces of the elastic roll and the side walls.

The invention is characterized in that the following are provided at both ends of the elastic roll in the axial direction thereof as members composing a sealing apparatus for sealing the ends of the elastic roll:

an outer covering member made of an elastic material, and having a first flange portion contacting the end face of the elastic roll and a first sleeve portion extending axially outward from the outer peripheral portion of the first flange portion;

a first supporting member made of a rigid material, and having a second flange portion contacting the outer surface of the first flange portion, outside in the axial direction from the first flange portion and a second sleeve portion extending axially outward from the outer peripheral portion of the second flange portion;

a second supporting member made of a rigid material, and having a third sleeve portion interposed between the shaft of the elastic roll and the second sleeve portion, outside in the axial direction from the second flange portion and a third flange portion extending in the radial direction of the elastic roll from the axially outward end face of the third sleeve portion;

an outer bearing interposed between the third sleeve portion and the second sleeve portion, and receiving radial and thrust forces;

inner bearings interposed between the third sleeve portion and the shaft of the elastic roll; and an end face sealing member interposed between the side wall and the third flange portion of the second supporting member, at least the outward side of the sealing member in the radial direction of the elastic roll being made of an elastic material.

The invention is characterized in that the surface of the rigid roll has a chrome-plated or tungsten carbide sprayed smooth layer, or is made of stainless steel.

In accordance with the invention, while a metal strip is sandwiched between the pair of elastic rolls and allowed to pass through between the elastic rolls, the surfaces of the metal strip are hermetically sealed. The rigid rolls and the elastic pushing members are provided between the elastic rolls and the furnace body or between the elastic rolls and the compartment casing. The rigid rolls are disposed further away from the surfaces of the metal strip than the elastic rolls, and rotate while hermetically contacting the elastic rolls to attain sealing. While contacting the rigid rolls, the elastic pushing members hermetically seals the boundary between the rigid rolls and the furnace body or between the rigid rolls and the compartment casing. Since the surface of the rigid roll is made of a hard material such as metal and finished to offer a very smooth surface, in case the surface layer portion of the elastic pushing member has a covering layer made of nonwoven fabric, the coefficient of mutual friction is very small even when the rigid roll contacts the nonwoven fabric while sliding and rotating. Therefore, even when the pushing member firmly pushes the rigid roll, the fibers of the nonwoven fabric do not fall out and are not fluffed. In case the surface of the rigid roll is a conductor and grounded via the roll shaft or the like, electrification of static electricity does not occur. Even when the surface of the rigid roll is an insulator, the electrification potential is very low and no problem occurs. Furthermore, even when the rigid roll surface made of a hard material such as metal is pushed firmly by the elastic pushing member, no scratch is generated on the roll surface by the fibers of the nonwoven fabric. Moreover, both the rigid roll and the elastic pushing member are not worn by friction. Consequently, the elastic pushing member can push the rigid roll sufficiently firmly, thereby maintaining stable sealing for an extended period of time.

Furthermore, in accordance with the invention, since the atmospheric gas includes hydrogen gas, the atmospheric gas is apt to explode and burn when the gas leaks to the outside air and is mixed with the outside air. However, since the sealing performance between the rigid roll and the elastic pushing member or between the rigid roll and the elastic roll is enhanced, the leakage of the atmospheric gas is reduced and the safety of operation can be enhanced.

Furthermore, in accordance with the invention, by the pair of intermediate rolls interposed between the pair of elastic rolls and the pair of the additional elastic rolls, a space for shutting off the outside air is formed outward from the sealing portion between the pair of elastic rolls and the metal strip, thereby being capable of reducing the leakage of the atmospheric gas to the outside air. The shut-off condition of the compartment casing from the outside air can be intensified and the safety of operation can be enhanced by supplying an inert gas, an atmospheric gas for an atmospheric heat treatment furnace, a gas similar to the atmospheric gas or nitrogen gas (these are hereinafter also generally referred to as an inert gas) into the space, or by reducing electrification of static electricity by means of ion neutralization caused by generating corona discharge, or by vacuuming the space.

Furthermore, in accordance with the invention, since the rubber material of the elastic roll or the additional elastic roll has electrical conductivity, spark discharge due to static electricity hardly generates. Even when the flammable atmospheric gas leaks, the danger of an explosion or the like can be reduced, thereby enhancing the safety of operation.

Furthermore, in accordance with the invention, since the surface of the elastic roll or the additional elastic roll is lined or integrated with conductive rubber, spark discharge due to static electricity hardly generates. Even when the flammable atmospheric gas leaks, the danger of an explosion can be reduced.

Furthermore, in accordance with the invention, the elastic pushing member is made of rubber or a sponge-like elastic body with foamed minute cells and has electrical conductivity corresponding to a specific electric resistance in the range of 1 to $10^7$ Ω·cm. Therefore, spark discharge is hardly caused by static electricity between the elastic pushing member and the rigid roll. Even when the flammable atmospheric gas leaks, the safety of operation can be enhanced.

Furthermore, in accordance with the invention, since the surface of the elastic body or the surface of the sponge-like elastic body has a covering layer made of nonwoven fabric having a thickness of 20 mm or less, the thickness of the covering layer made of nonwoven fabric having a ventilating characteristic is relatively thin. Therefore, the sealing performance can be enhanced.

Furthermore, in accordance with the invention, the nonwoven fabric has a self-extinguishing characteristic, since it has a limit oxygen index (LOI) value of 26 or more. Even when a fire occurs in the air, the fire is extinguished spontaneously, thereby enhancing the safety of operation.

Furthermore, in accordance with the invention, since the hardness of the surface of the elastic pushing body is in the range of 10° to 50° specified in JIS S 6050, the elastic pushing body contacts the elastic roll uniformly, and thereby hermetic sealing can be attained.

Furthermore, in accordance with the invention, the electrical conductivity of the elastic roll or the like elastic pushing body is provided by mixing carbon thereto. Since the wear resistance is also enhanced by mixing carbon in rubber, stable sealing performance can be maintained for an extended period of time.

Furthermore, in accordance with the invention, at both ends of the elastic roll in the axial direction thereof, the elastic discs and slip discs are interposed between the end face of the elastic roll and the casing. While the elastic roll is allowed to rotate by the rotating and sliding contact of the slip discs in particular, the hermetic sealing between the elastic roll and the casing can be attained by the elastic discs.

Furthermore, in accordance with the invention, between the end face of the elastic roll and the side wall at each end of the elastic roll in the axial direction thereof, the elastic roll end face sealing device comprises the outer covering member and the end face sealing member, both made of an elastic material, the first supporting member and the second supporting member, both made of a rigid material, an outer bearing subjected to radial and thrust forces, and inner bearings subjected to radial forces so as to isolate the hermetic sealing function from the bearing function, thereby enhancing the sealing performance and reducing the rotation loads.

BEST MODE FOR EMBODYING THE INVENTION

Figure 1:
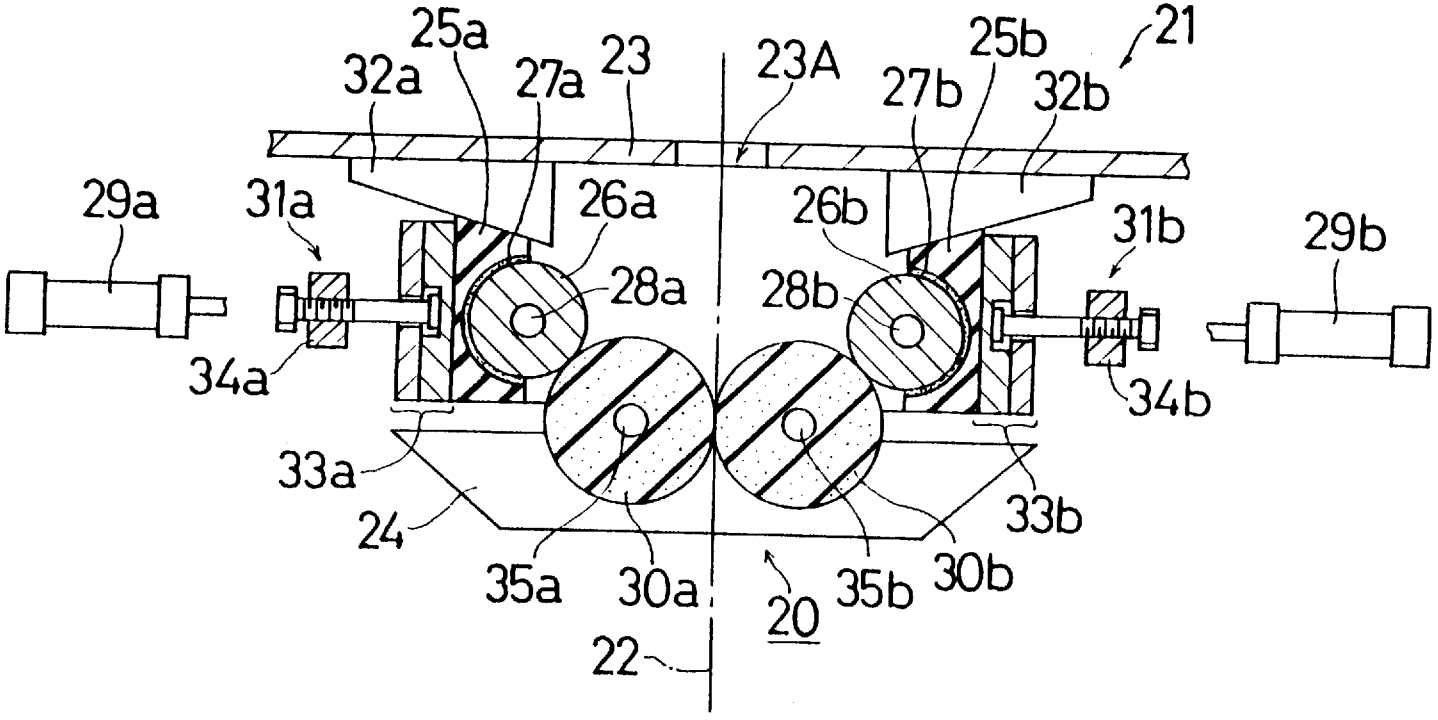
FIG. 1 is a sectional front view showing a first embodiment of the invention.
Figure 2:
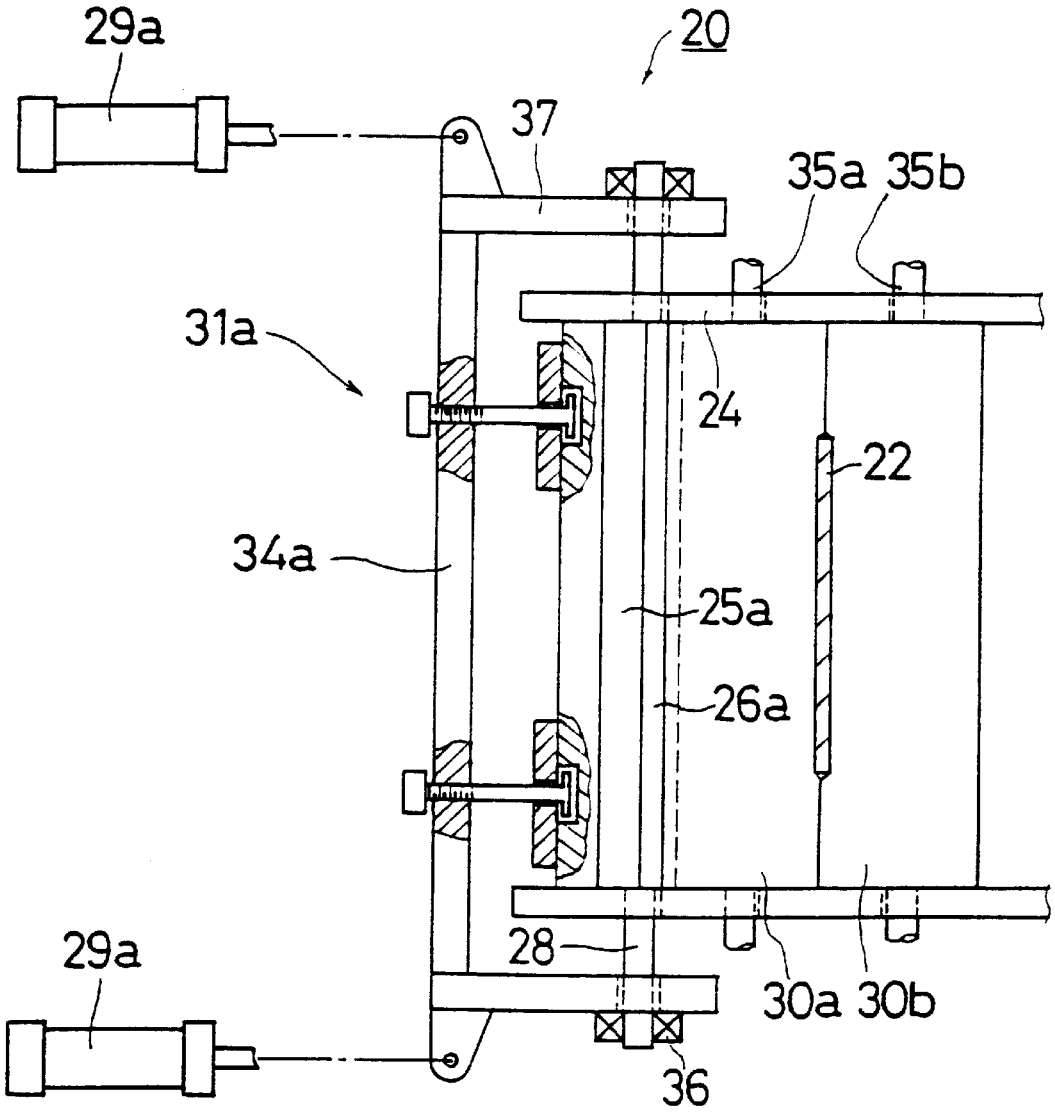
FIG. 2 is a partial bottom view showing the first embodiment.
Figure 3:
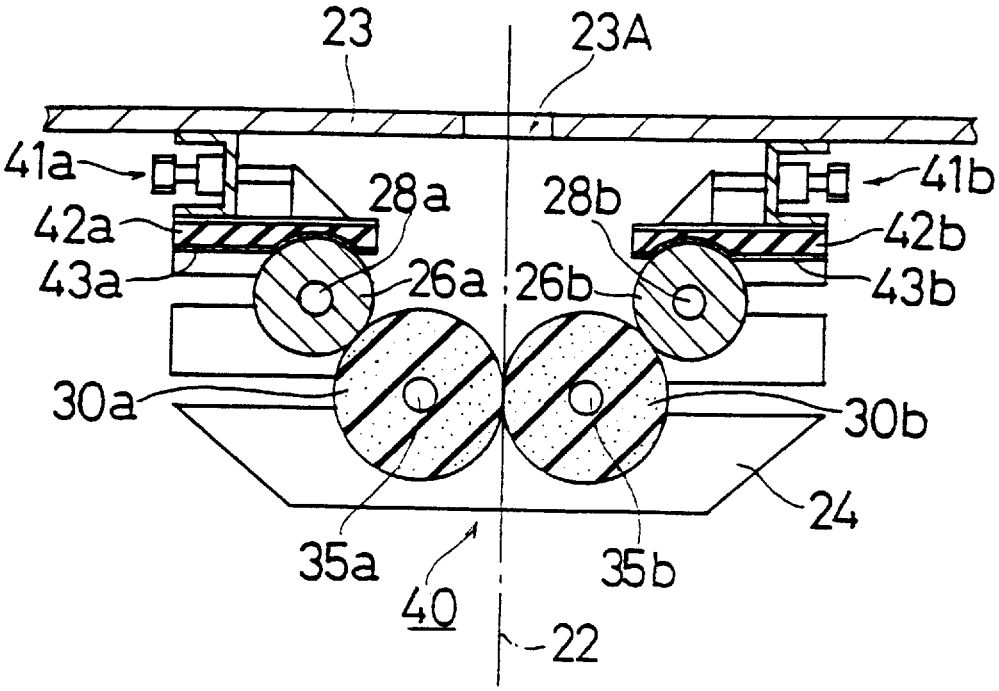
FIG. 3 is a sectional front view showing a second embodiment of the invention.
Figure 4:
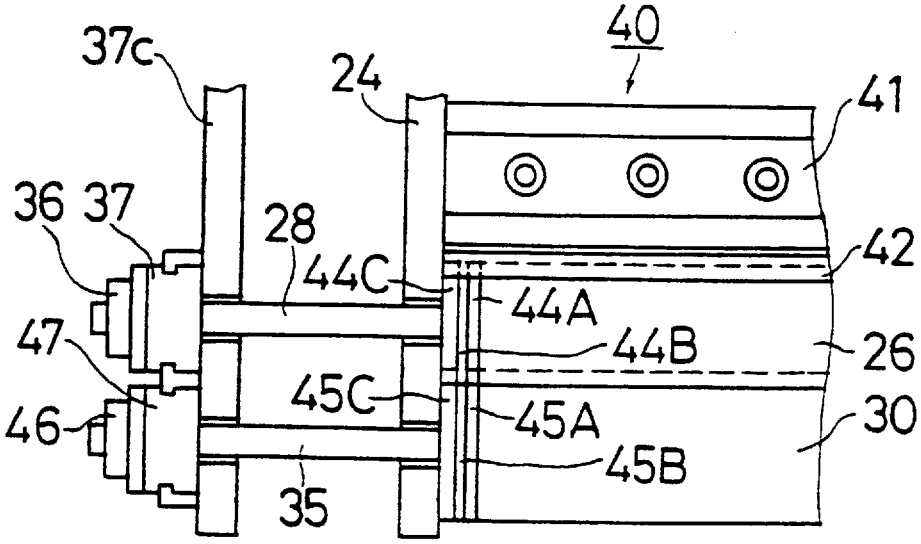
FIG. 4 is a side view showing the second embodiment.
Figure 5:
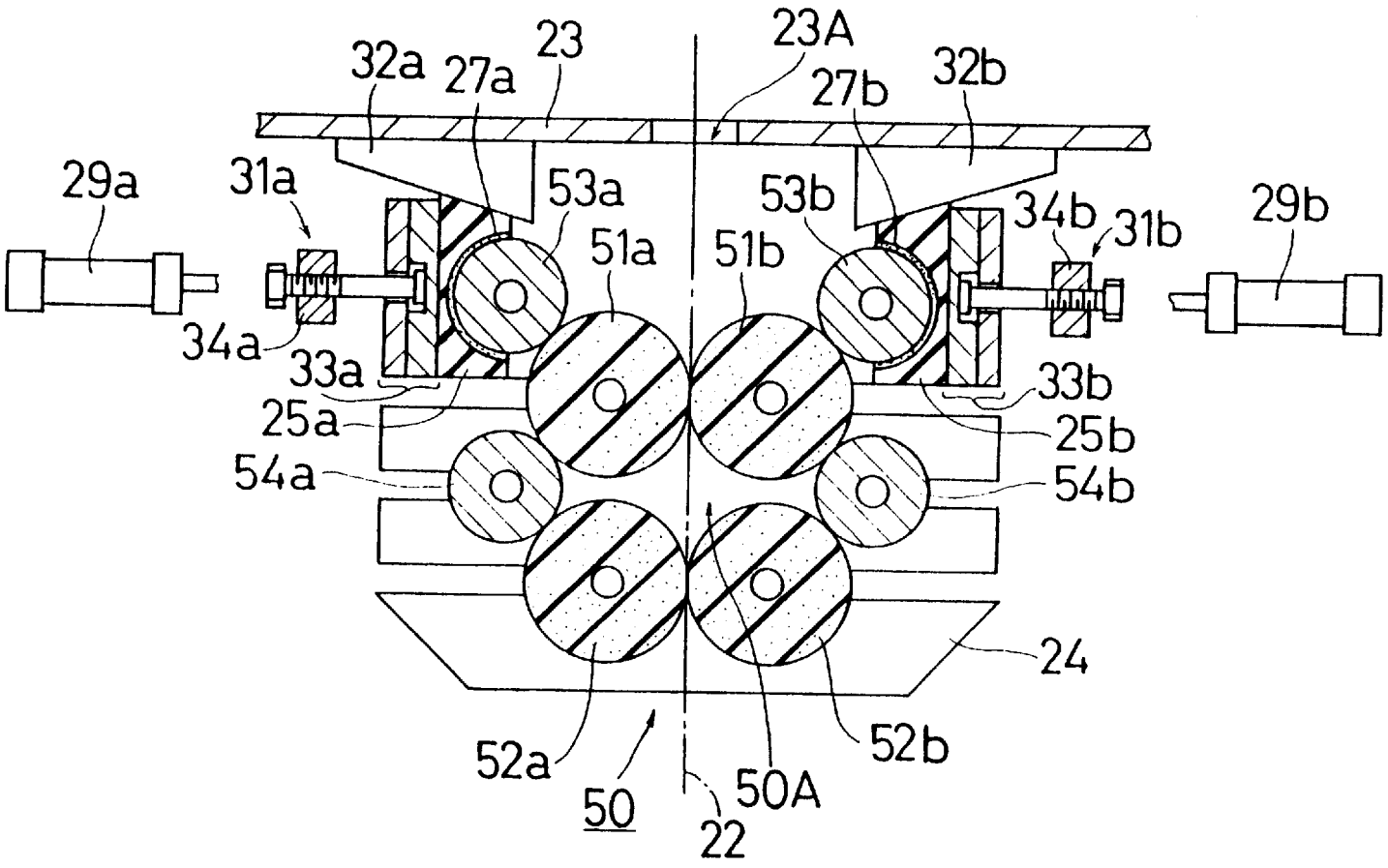
FIG. 5 is a sectional front view showing a third embodiment of the invention.
Figure 6:
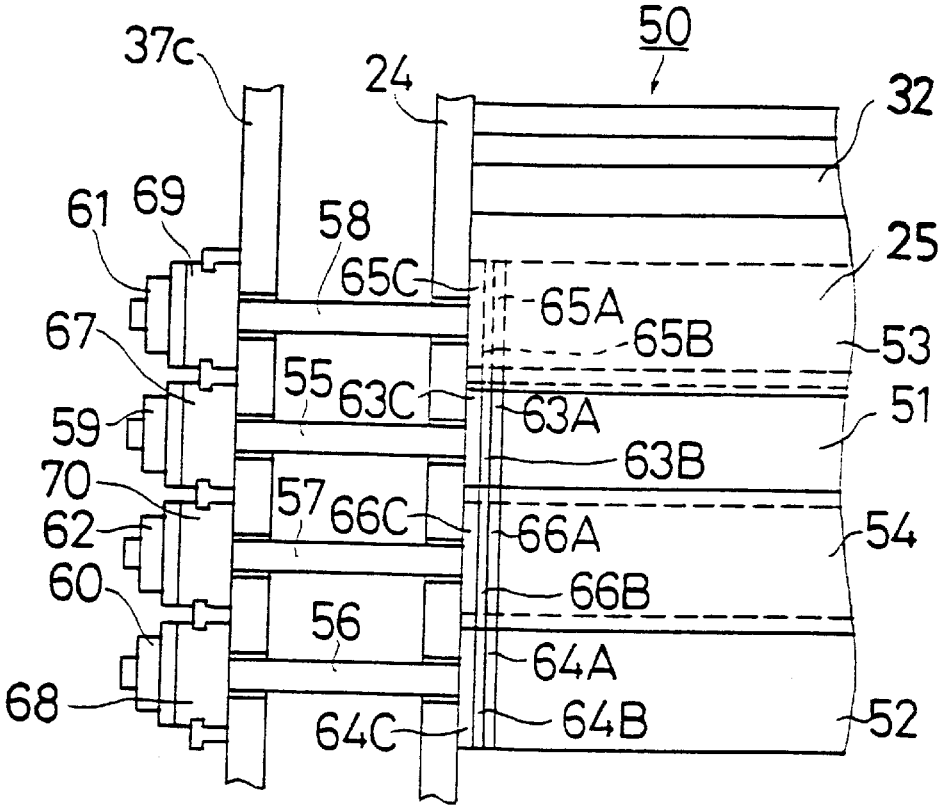
FIG. 6 is a side view showing the third embodiment.
Figure 7:
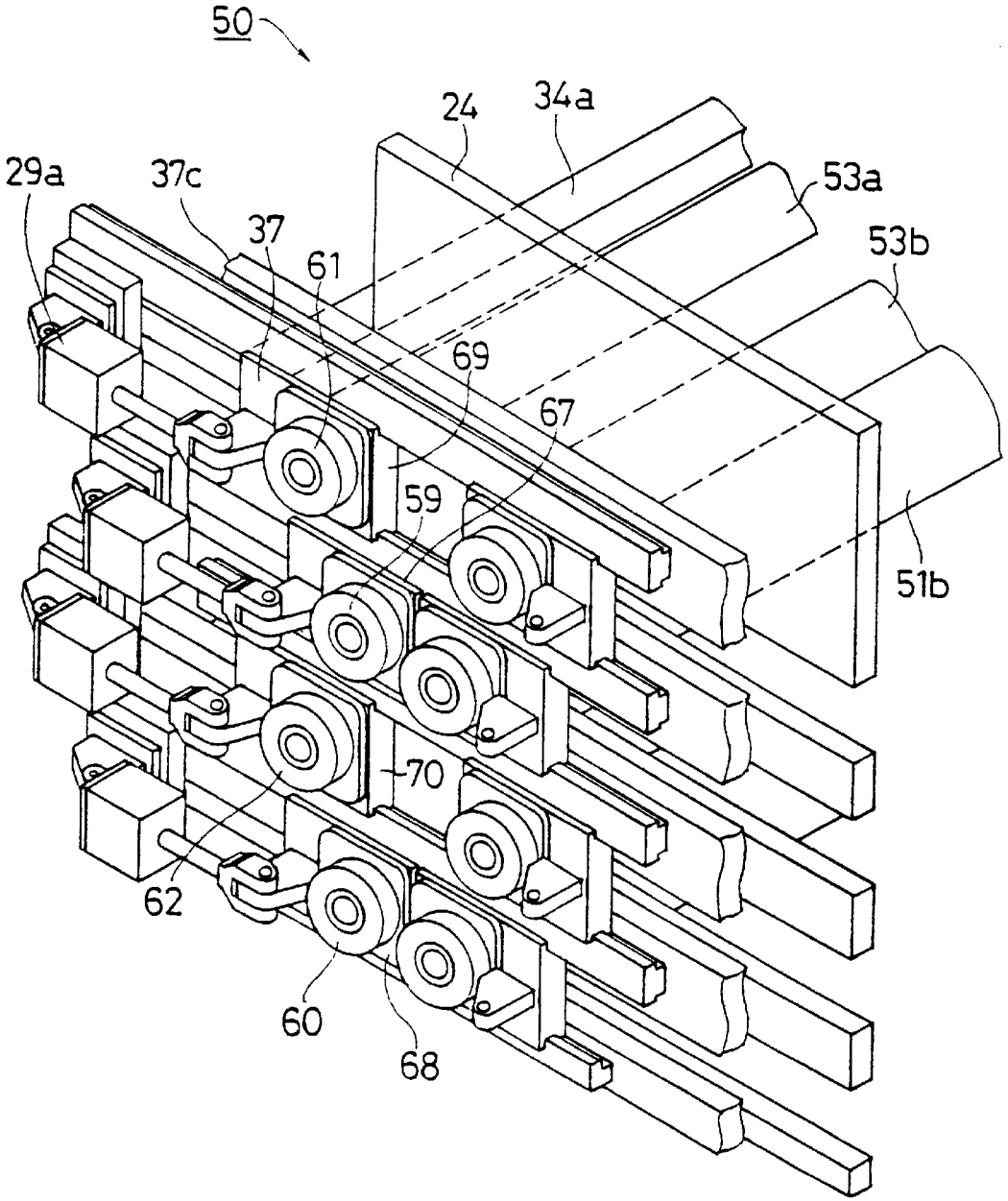
FIG. 7 is a partial perspective view showing the third embodiment.
Figure 8:
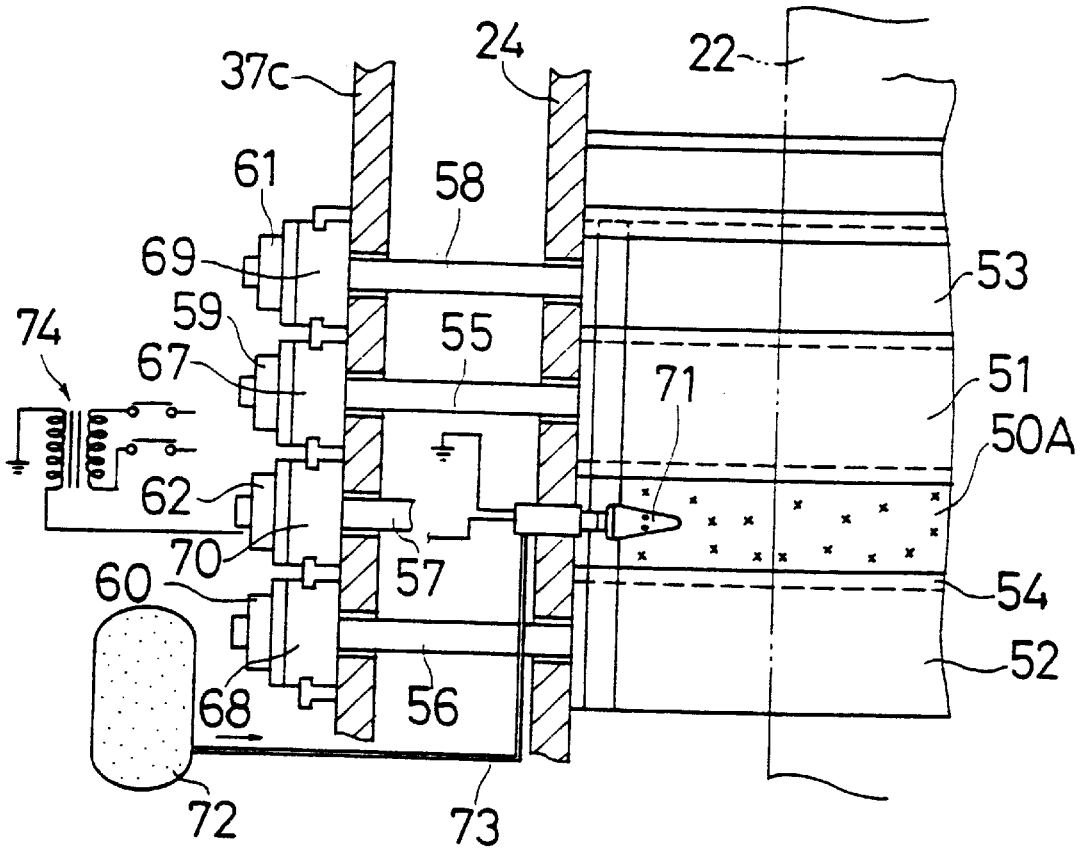
FIG. 8 is a sectional side view showing a fourth embodiment of the invention.
Figure 9:
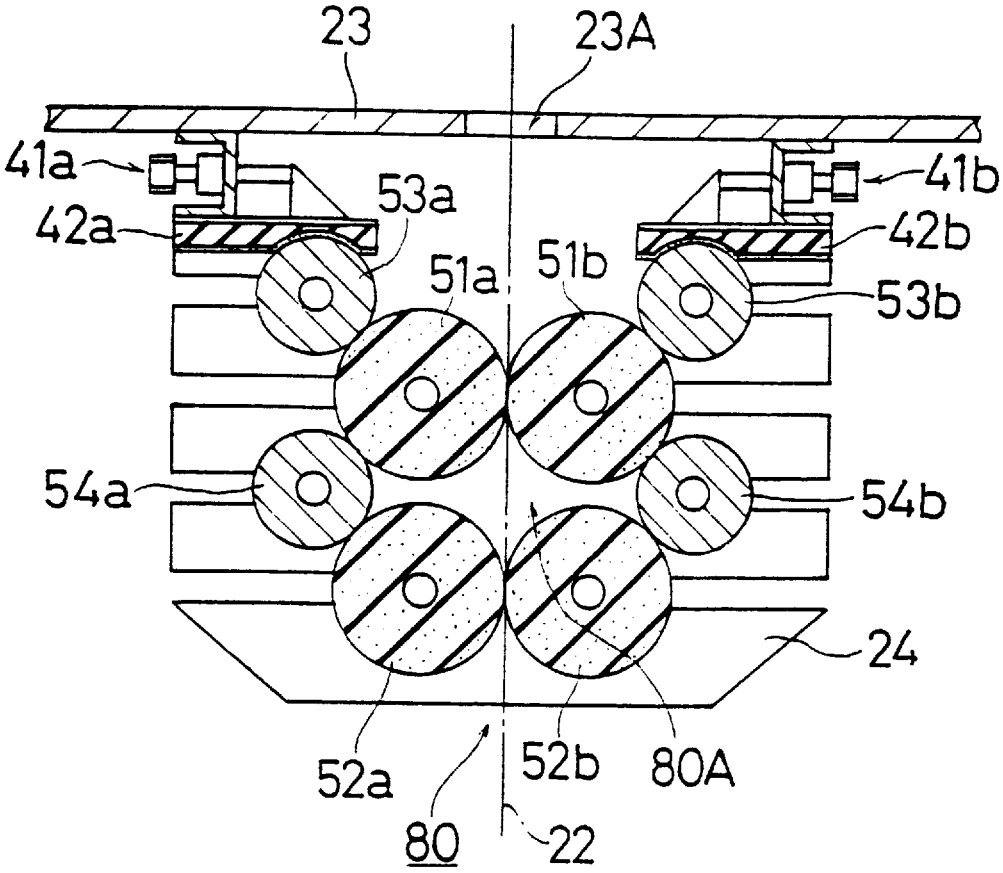
FIG. 9 is a sectional front view showing a fifth embodiment of the invention.
Figure 10:
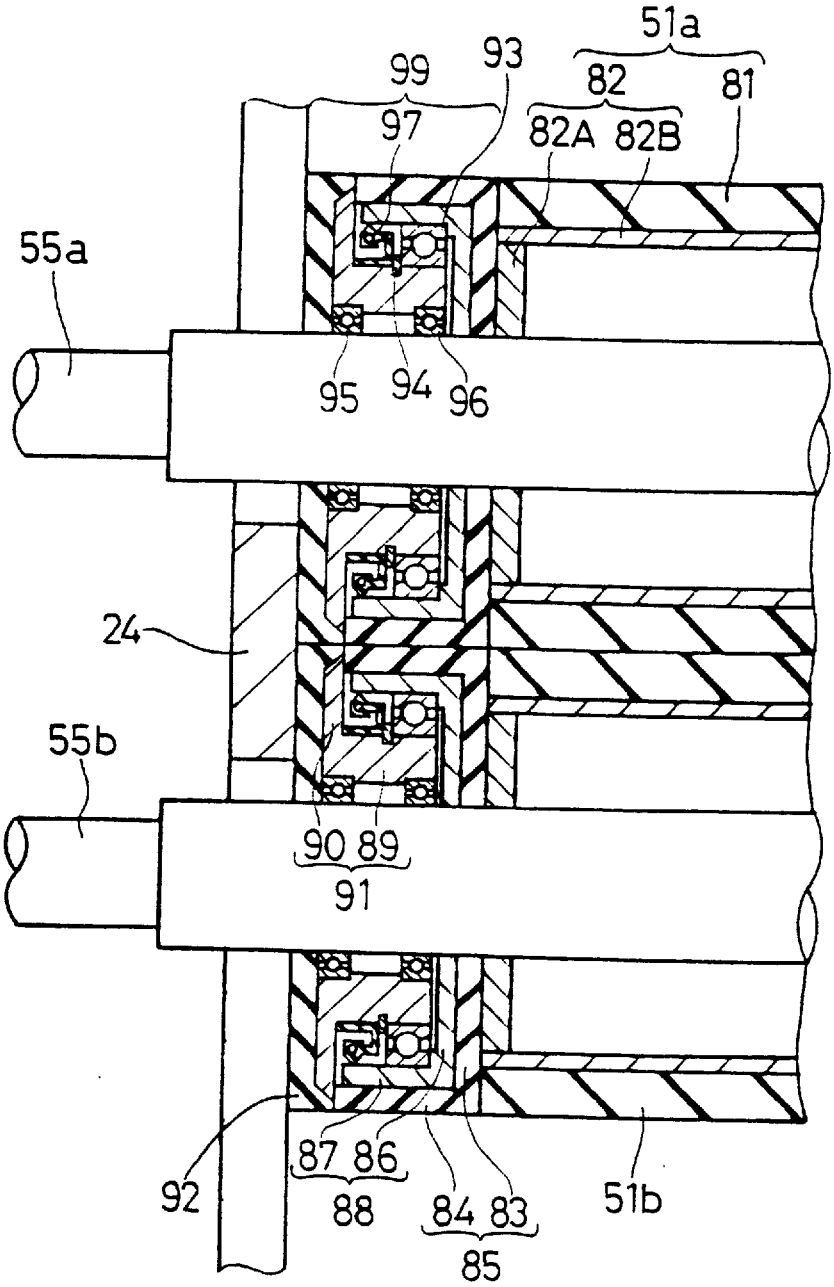
FIG. 10 is a partially sectional plane view showing the fifth embodiment.
Figure 11:
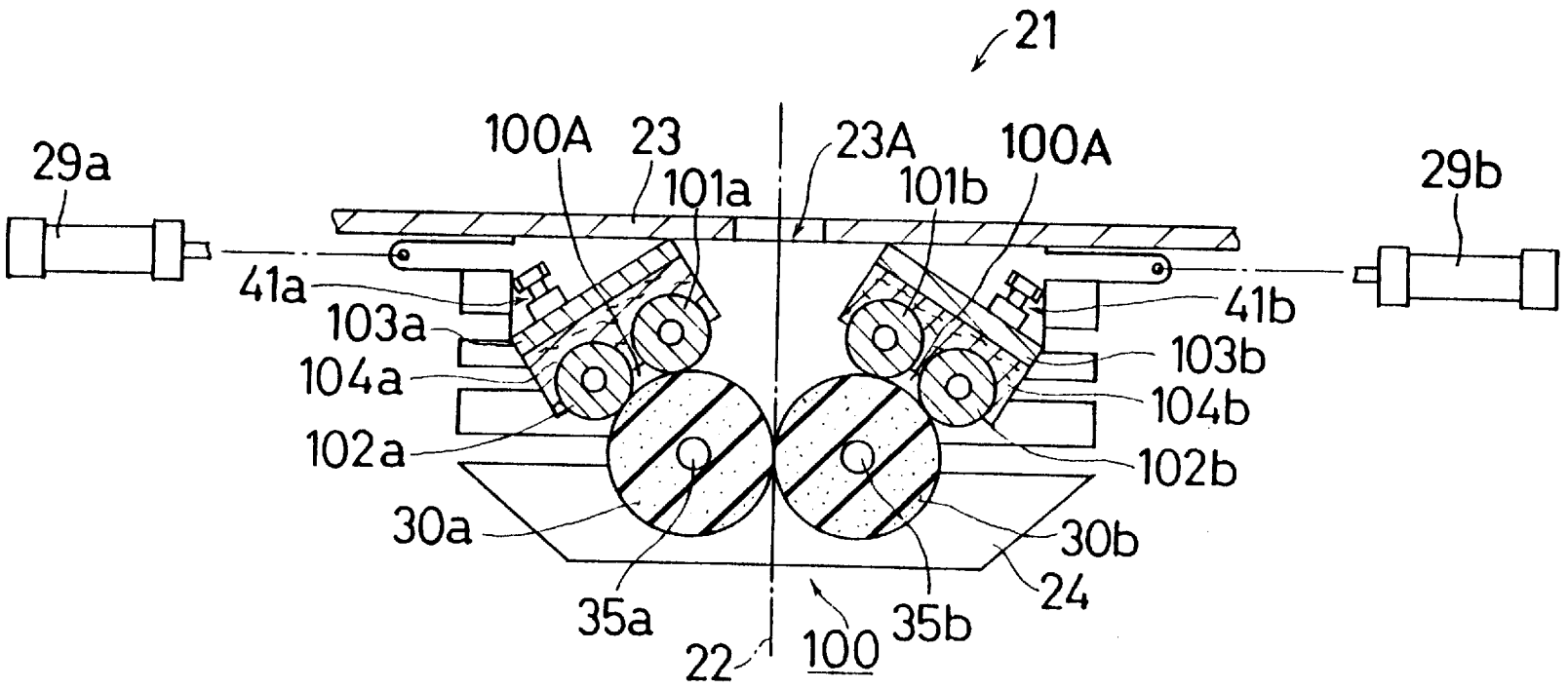
FIG. 11 is a sectional front view showing a sixth embodiment of the invention.
Figure 12:
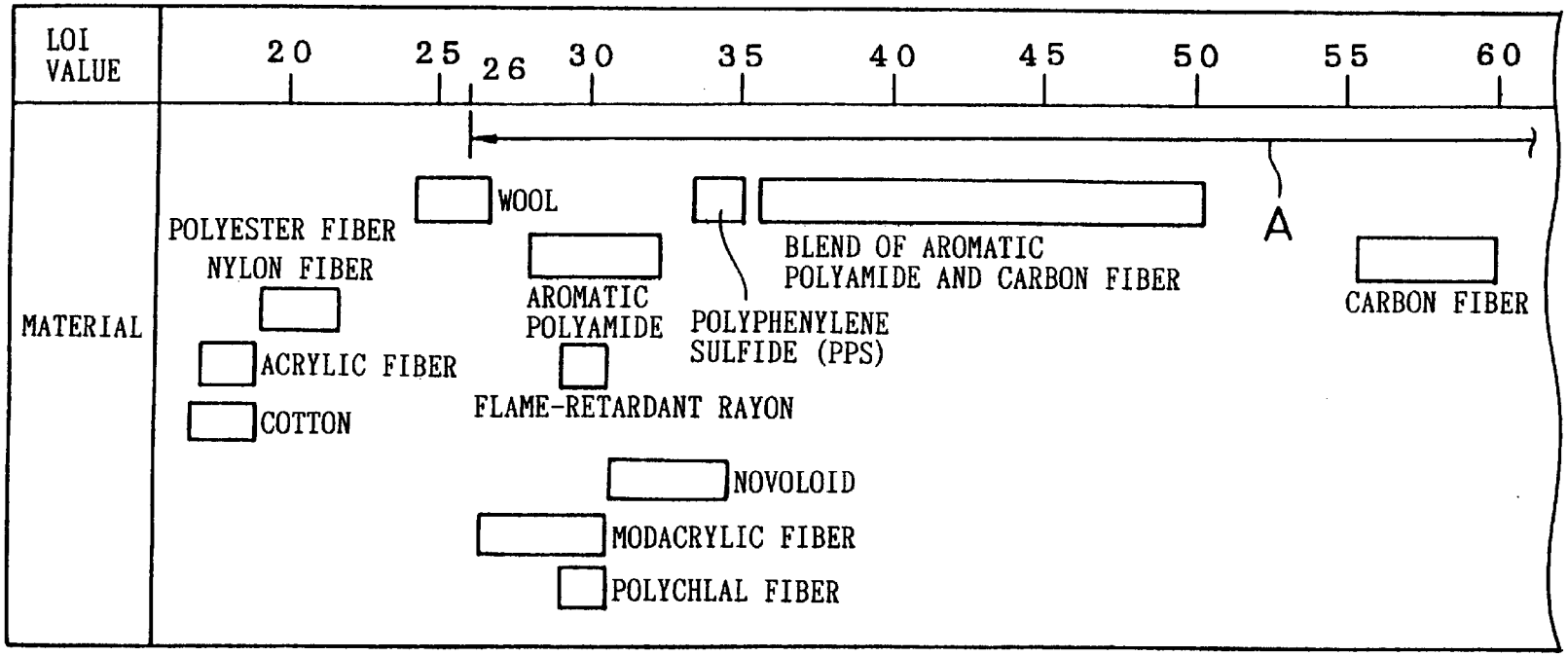
FIG. 12 is a graph showing materials corresponding to LOI values.
Figure 13:
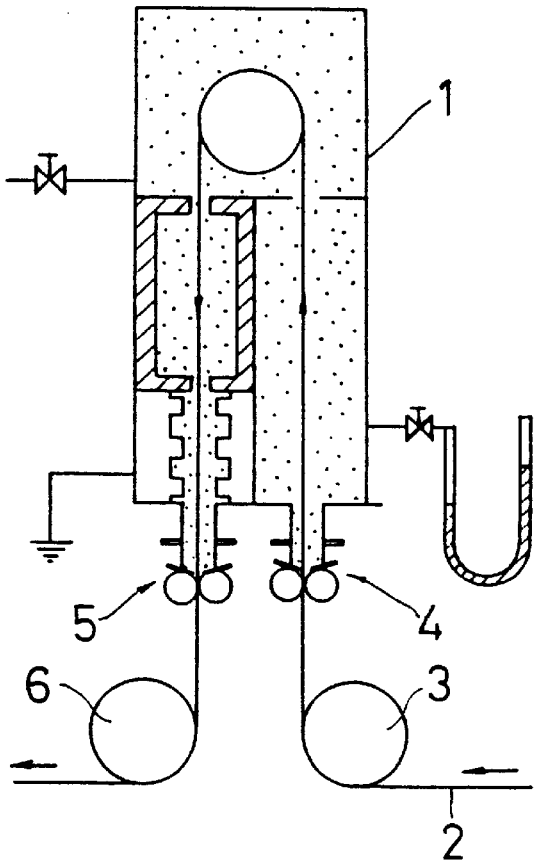
FIG. 13 is a simplified sectional view showing a basic structure of a bright annealing furnace.
Figure 14:
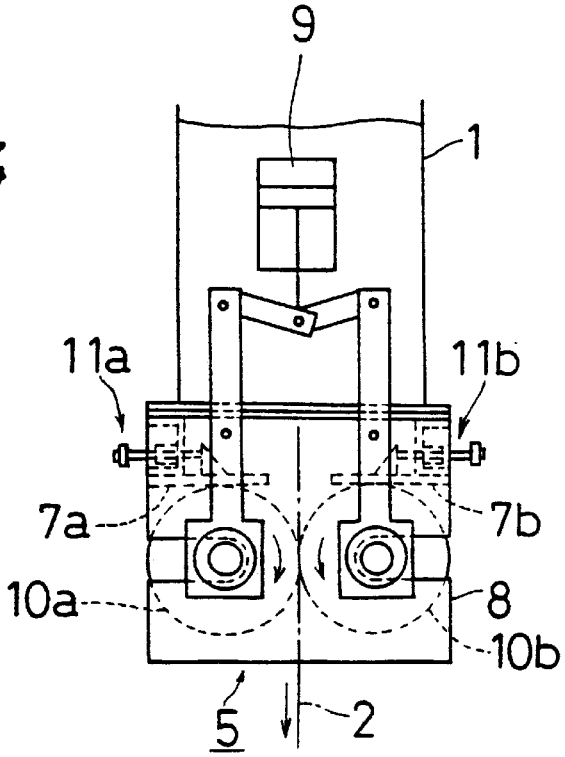
FIG. 14 is a front view showing the sealing apparatus used at the inlet/outlet of the furnace shown in FIG. 13.

FIG. 1 is a sectional front view showing a first embodiment of the invention; FIG. 2 is a bottom view showing the main portion of the first embodiment; FIG. 3 is a sectional front view showing a second embodiment of the invention; FIG. 4 is a side view showing the second embodiment; FIG. 5 is a sectional front view showing a third embodiment of the invention; FIG. 6 is a side view showing the third embodiment; FIG. 7 is a partial perspective view showing the third embodiment; FIG. 8 is a sectional side view showing a fourth embodiment of the invention; FIG. 9 is a sectional front view showing a fifth embodiment of the invention; FIG. 10 is a partial sectional plane view showing the fifth embodiment; FIG. 11 is a sectional front view showing a sixth embodiment of the invention; FIG. 12 is a graph showing materials corresponding to limit oxygen index (LOI) values.

The same reference numerals designate the corresponding parts in each drawing. Subscripts a and b added to the same reference number designate a pair of parts disposed symmetrically with respect to a metal strip on both sides of the metal strip. Such a pair of parts are generally designated by the same reference number.

In a sealing apparatus 20 in accordance with the first embodiment of the invention shown in FIGS. 1 and 2, hermetic sealing is performed at the inlet or outlet of a bright annealing furnace 21 while a metal strip 22, such as a stainless steel strip, is passed through. The partition wall 23 of the bright annealing furnace 21 is provided with an opening 23A to allow the metal strip 22 to pass through, and the sealing apparatus 20 is provided outward from the opening 23A. Side walls 24 are provided on both sides of the metal strip 22 in the width direction thereof. Pushing members 25*a*, 25*b* and rigid rolls 26*a*, 26*b* are provided between the side walls 24. The pushing members 25*a*, 25*b* are made of a rubber-based elastic material and the rigid rolls 26*a*, 26*b* are made of metal, for example.

The pushing members 25*a*, 25*b* contact the rigid rolls 26*a*, 26*b* via nonwoven fabrics 27*a*, 27*b* respectively to perform hermetic sealing. The sealing performance is enhanced as the contact portion is longer because of the labyrinth effect. However, the length of the contact portion should preferably be a half of the outer peripheries of the rigid rolls 26*a*, 26*b* by considering the ease of removal of the rigid rolls 26*a*, 26*b* from the pushing members 25*a*, 25*b*. The rigid rolls 26*a*, 26*b* have smooth chrome-plated surfaces rated at ▽▽▽, Ra 1.6a, Rmax 6.3S, Rz 6.3Z or less specified in JIS B 0031 (1982). Therefore, even when a long contact portion is formed, the friction coefficient at the contact portion is small (for example, $\mu \approx 0.5$ between rubber and nonwoven fabric, $\mu \approx 0.05$ between chrome-plated surface and nonwoven fabric). Accordingly, high resistance is not caused, and the fibers of the nonwoven fabrics 27*a*, 27*b* hardly fall out, thereby hardly causing pressure marks to the metal strip 22 in case fallen fiber chips attach to the surfaces of the metal strip 22 and are pressed against the metal strip 22 by rolls of a rolling machine at the next process, and thus reducing the problem of deteriorating the metal strip 22. Consequently, the rigid rolls can be pushed firmly by the pushing members. Even when the rigid rolls are pushed firmly, as long as the surfaces of the rigid rolls are conductors and grounded via the roll shafts thereof or the like, static electricity is not electrified. Even if the surfaces are insulators, the electrification potential is very low, thereby causing no problem. In addition, since the rolls have wear resistance and long service life, the rolls can be used stably for an extended period of time. Furthermore, since the surfaces chrome-plated or made of tungsten carbide or stainless steel are rust free, the rolls can rotate and slide smoothly. The rigid rolls 26*a*, 26*b* rotate around shafts 28*a*, 28*b*, and are pushed against elastic rolls 30*a*, 30*b* by cylinders 29*a*, 29*b* to perform hermetic sealing. The elastic rolls 30*a*, 30*b* made of a rubber-based elastic material push both sides of the metal strip 22 by sandwiching the strip. Consequently, hermetic sealing is attained between the metal strip 22 and the elastic rolls 30*a*, 30*b*.

The pushing forces of the pushing members 25*a*, 25*b* against the rigid rolls 26*a*, 26*b* can be adjusted by means of pushing force adjustment devices 31*a*, 31*b*. Over the pushing members 25*a*, 25*b*, pushing member stoppers 32*a*, 32*b* are provided. On the back sides of the pushing members 25*a*, 25*b*, pushing members frames 33*a*, 33*b* are provided to receive the pushing forces from the pushing force adjustment devices apparatuses 31*a*, 31*b*. Connection frames 34*a*, 34*b* are provided with screw holes which constitute the pushing force adjustment devices 31*a*, 31*b*. The shafts 35*a*, 35*b* of the elastic rolls 30*a*, 30*b* can be displaced in the direction perpendicular to the surface of the metal strip 22 on both sides of the metal strip 22. Bearings 36 for supporting the shafts 28*a*, 28*b* of the rigid rolls 26*a*, 26*b* are installed on slide plates 37 which are connected to each other by the connection frames 34*a*, 34*b*.

As shown in FIG. 3, in a sealing apparatus 40 in accordance with the second embodiment of the invention, pushing force adjustment devices 41*a*, 41*b* push seal pads 42*a*, 42*b*, which are in almost horizontal conditions, against the rigid rolls 26*a*, 26*b*. The seal pads 42*a*, 42*b* are made of a rubber-based elastic material and their surfaces are coated with nonwoven fabrics 43*a*, 43*b*. The lengths of the contact portions between the nonwoven fabrics 43*a*, 43*b* and the rigid rolls 26*a*, 26*b* should preferably be 1/15 or more of the outer peripheries of the rigid rolls 26*a*, 26*b* to ensure the sealing performance.

As shown in FIG. 4, in the sealing apparatus 40 in accordance with the second embodiment, the hermetic sealing at both ends of the rigid rolls 26*a*, 26*b* and the elastic rolls 30*a*, 30*b* in the axial directions thereof is performed by interposing two pairs of slip discs 44A, 44B; 45A, 45B made of Teflon (PTFE) or mainly consisting of Teflon, for example, and elastic discs 44C, 45C made of rubber having a hardness of 55° specified in JIS K 6301 A, for example, between the ends of the rolls and the side walls 24. Instead of combining the slip discs 44A, 44B; 45A, 45B mainly consisting of Teflon as a pair respectively so as to slip from each other, the combination of a disc made of metal and a disc mainly made of fluororesin, for example, may be used, provided that they are rigid and made of materials easily slidable from each other. When the combination of discs made of fluororesin is used, the fluororesin should preferably have an electrostatic specific resistance in the range of 1 to $10^7$ Ω·cm to prevent electrification of static electricity. The elastic discs 44C, 45C are made of a rubber-based elastic material. Sealing is performed when the slip discs 44A, 44B contact each other and the slip discs 45A, 45B also contact each other while rotating and sliding. On the other hand, the elastic discs 44C, 45C exert appropriate elastic repulsion forces to push the slip discs 44A, 44B; 45A, 45B so as to close the clearances, thereby performing sealing. This kind of sealing structure at both ends in the axial direction can also be applied to the first embodiment and other embodiments similarly. In the same way as the connection frames 34*a*, 34*b* are used to connect the bearings 36 and the slide plates 37 to the shaft 28, a connection frame for connecting bearings 47 to the shaft 35 is provided for each roll (only the connection frame 34 is shown.)

As shown in FIGS. 5, 6 and 7, in a sealing apparatus 50 in accordance with the third embodiment of the invention, second elastic rolls 52*a*, 52*b* used as additional elastic rolls are provided outward from first elastic rolls 51*a*, 51*b*. Rigid rolls 53*a*, 53*b* are provided inward from the first elastic rolls 51*a*, 51*b*, and intermediate rolls 54*a*, 54*b* are provide between the first elastic rolls 51*a*, 51*b* and the second elastic rolls 52*a*, 52*b* so as to form a buffering space 50A separated from the outside air.

The shafts 55, 56 of the first and second elastic rolls 51*a*, 51*b*; 52*a*, 52*b* and the shafts 58, 57 of the rigid rolls and intermediate rolls 53*a*, 53*b*; 54*a*, 54*b* are supported by bearings 59, 60, 61, 62 respectively. Furthermore, in the same way as shown in FIG. 4, the shafts 55, 56, 58, 57 are hermetically sealed at both ends in the axial direction thereof via slip discs 63A, 63B; 64A, 64B; 65A, 65B; 66A, 66B and elastic discs 63C; 64C; 65C; 66C. The bearings 59, 60, 61, 62 are mounted on a guide frame 37*c* via slide plates 67, 68, 69, 70.

As shown in FIG. 8, in the fourth embodiment of the invention, an ion generator 71 is installed in the space 50A of the third embodiment. Ions generated by corona discharge due to high voltage power from a high voltage power source 74 are added to an inert gas supplied from an inert gas supplying device 72 via a pipe line 73 so as to eliminate static electricity by neutralization. In the space 50A, only the inert gas may be supplied. En particular, when the inert gas supplying device 72 is installed on the inlet side, the inert gas supplying device 72 is effective in cleaning the air attached to the surface of the metal strip 22 and brought from the outside of a compartment and in cleaning the outside air including vapor and oxygen. Furthermore, the space 50A may be subjected to vacuum suction. With this structure, the outside air hardly enters the interiors of facilities or compartments, such as reduced pressure compartments or vacuum compartments of vacuum evaporation facilities.

As shown in FIG. 9, a sealing apparatus 80 in accordance with the fifth embodiment of the invention is similar to the third and fourth embodiments in that a space 80A is formed, and also similar to the second embodiment with respect to the sealing structure between the rigid rolls 53*a*, 53*b* and the seat pads 42*a*, 42*b*. In the third to fifth embodiments, although only one space 50A or 80A is provided in the area surrounded by the elastic rolls 51*a*, 51*b*; 52*a*, 52*b*, more than one similar space can be provided by adding intermediate rolls and elastic rolls. For example, a multiple sealing apparatus used for a vacuum evaporation facility or the like, such as the prior art disclosed in Japanese Examined Patent Publication JP(B2) 6-45875 (1994) can be put to practical use effectively.

FIG. 10 shows the structure of an elastic roll end face sealing device 99 for hermetically sealing both ends of the shafts 55*a*, 55*b* of the first elastic rolls 51*a*, 51*b* in accordance with the fifth embodiment. The covering 81 of the elastic roll 51*a* is made of a rubber-based elastic material and formed on the surface of a metallic roll 82 comprising a disc 82A and a cylinder 82B. Outward from the disc 82A in the axial direction thereof, an outer covering member 85 made of a rubber-based elastic material and comprising a first inward flange portion 83 and a first sleeve portion 84 is installed. Inward from the outer covering member 85 in the radial direction thereof, a first supporting member 88 made of metal and comprising a second inward flange portion 86 and a second sleeve portion 87 is installed. Inward from the first supporting member 88 in the radial direction thereof, a second supporting member 91 made of metal and comprising a third sleeve portion 89 and a third outward flange portion 90 is installed. Outward from the second supporting member 91 in the axial direction thereof, an end face sealing member 92 made of a rubber-based elastic material is installed. The expression "inward" or "outward" used to describe the first, second and third flange portions designates inward or outward with respect to the corresponding axial direction. However, the orientation of the flange portions can be set either inward or outward.

The first inward flange portion 83 hermetically seals the boundary between the end face of the first elastic roll 51 in the axial direction thereof and the second inward flange portion 86. The first sleeve portion 84 closely contacts the face of the second sleeve portion 87. The inner surface of the end face sealing member 92 closely contacts the outside of the third outward flange portion 90 in the axial direction thereof. The outer peripheral surface of the third outward flange portion 90 is tapered. The tip of the first sleeve portion 84 directly contacts the axially inward portion of the outer peripheral portion of the third outward flange portion 90 and the tip of the end face sealing member 92. Instead of the direct contact, a disc made of Teflon or mainly consisting of Teflon (not shown, 1 to 2 mm in thickness, outer diameter being as large as that of the third outward flange portion 90) can be installed inward from the third outward flange portion 90 in the axial direction thereof so as to reduce frictional resistance, thereby obtaining a structure being further resistant to wear. The axial length of the second sleeve portion 87 is made shorter than the axial length of the third sleeve portion 89 so that the end face of the second sleeve portion 87 does not contact the third outward flange portion 90. In addition, the surface of the second inward flange portion 86 has a recessed step so that the end face of the third sleeve portion 89 does not contact the second inward flange portion 86.

A space is provided between the second sleeve portion 87 and the third sleeve portion 89, and another space is provided between the third sleeve portion 89 and the shaft 55. An outer bearing 93, a deep-groove ball bearing, is interposed between the second sleeve portion 87 and the third sleeve portion 89 so as to receive radial forces in the radial direction and thrust forces in the axial direction. A retaining ring 94 is provided on the inner race side of the outer bearing 93 so as to prevent the outer bearing 93 from being displaced by thrust forces. The outer race of the outer bearing 93 contacts the thicker portion of the second inner flange portion 86. Inner bearings 95, 96 are installed between the third sleeve portion 89 and the shaft 55. The inner bearings 95, 96 are fit in the grooves formed on the inner peripheral side of the third sleeve portion 89 so as to receive radial forces. A lip seal 97 made of a substance mainly consisting of NBR or PTFE (Teflon) can be provided so as to hermetically seat the boundary between the second sleeve portion 87 and the third sleeve portion 89. The same structure as that of the elastic roll end face sealing device 99 can also be used for the rigid rolls and the intermediate rolls. Furthermore, the roll side and the opposite roll side of the structure can be replaced each other. In that case, the inner bearings can be omitted. In other words, the elastic roll end face sealing device 99 can be used instead of the combinations of the slip discs (44A, 44B, etc.) and the elastic discs (44C, 45C) in FIG. 4 (the second embodiment), and the slip discs (63A, 63B, etc.) and the elastic discs (63C, 64C, 65C, 66C) in FIG. 6 (the third embodiment). Furthermore, the elastic roll end face sealing device 99 can also be used for the first embodiment and other embodiments of the invention as a matter of course.

A rubber-based elastic material is cylindrically coated on the cylinder 82B in the axial direction there of, that is, on the outer peripheral surface of the metallic roll 82 in the longitudinal direction thereof so as to form the covering 81 thereon. Alternatively, a cylindrical sleeve made of a rubber-based elastic material can be also fitted on the outer periphery of the metallic roll 82 so as to form the covering 81 thereon. Furthermore, the covering can be directly formed on the outer periphery of the metal shaft. In the first to fourth embodiments, the elastic roll similar to that described above can also be used as the first elastic roll or the second elastic roll.

As shown in FIG. 11, although a sealing apparatus 100 of the sixth embodiment of the invention is similar to that of the second embodiment, the sealing apparatus 100 is characterized in that first rigid rolls 101*a*, 101*b* and second rigid rolls 102*a*, 102*b* contact the elastic rolls 30*a*, 30*b* at inward positions close to the opening 23A, and spaces 100A are formed by the combinations of the elastic rolls 30*a*, 30*b*, the rigid rolls 101*a*, 102*a*, 101*b*, 102*b*, and seal pads 104*a*, 104*b* attached to the surfaces of sealing fixtures 103*a*, 103*b* so as to perform double sealing against the outside air. In addition, the spaces 100A can be supplied with an inert gas, or the spaces 100A can be subjected to vacuum suction (not shown), thereby ensuring further hermetic sealing between the outside air and the interior of the compartment. The first and second rigid rolls 101, 102 are made of metal, and the seal pads 104 are made of nonwoven fabric such as felt. In the sixth embodiment shown in FIG. 11, the elastic roll end face sealing device 99 of the fifth embodiment shown in FIG. 10 can also be used for the first rigid rolls 101*a*, 101*b*, the second rigid rolls 102*a*, 102*b* and the elastic rolls 30*a*, 30*b* just as in the case of the first to fourth embodiments. Furthermore, the structure of the elastic rolls 30*a*, 30*b* is the same as that of the fifth embodiment just as in the case of the first to fourth embodiments.

In the above-mentioned embodiments, as the rubber-based elastic material for the elastic rolls 30, 51, 52, the pushing members 25, the seal pads 42, etc., natural rubber and synthetic rubber selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber and hydrin rubber can be used. When electrical conductivity is offered by adding carbon or metal powder, spark discharge due to static electricity hardly occurs. In case rubber itself has electrical conductivity, the rubber can be used as it is. The conductivity should preferably be in the range of 1 to $10^7$ Ω·cm in terms of a specific electric resistance. When the specific electric resistance is lower than this range, spark discharge is apt to occur in case static electricity is generated in the surrounding area. When the specific resistance is larger than this range, static electricity is electrified and spark discharge is apt to occur.

The hardness of the rubber used for the elastic rolls 30, 51, 52 should preferably be in the range of 40° to 90° specified in JIS K 6301 A. The hardness of the rubber used for the pushing members 25 and the seal pads 42 should preferably be in the range of 10° to 50° specified in JIS S 6050, and the rubber should also preferably be made in a minute-expanded-sponge form. When the hardness is lower than these ranges, the strength is insufficient, and satisfactory sealing performance cannot be obtained. When the hardness is higher than these ranges, the flexibility is insufficient, and satisfactory sealing performance cannot be obtained.

As shown in FIG. 12, the self-extinguishing characteristic of each material is evaluated in accordance with the value of LOI, limit oxygen index. Since the nonwoven fabrics 27 on the surface of the pushing members 25, the nonwoven fabrics 43 on the surface of the seal pads 42 and the seal pads 104 on the surface of the sealing fixtures 103 are exposed to flames in case of a fire, these members should preferably be made of materials capable of satisfying the condition that the LOI value shown in FIG. 12 is 26 or more as indicated by A, that is, "the minimum volume percentage of oxygen required to maintain combustion of fiber is 26% or more." Suitable materials are aromatic polyamide (aramid), polyphenylene sulfide (PPS), a blend of aromatic polyamide and carbon fiber, carbon fiber or the like, for example. The melting point of PPS is 285° C. The para-type aramide decomposes at 430° C. and the meta-type aramide decomposes at 371° C., and they self-extinguish. Since the carbon fiber is inactive at 300° C. or less, the fiber is sufficiently heat resistant in the case of a fire in a short period of 10 seconds or less at the sealing apparatus. Since a nonwoven fabric has a ventilating characteristic, the ventilating characteristic should preferably be lowered by using a thin nonwoven fabric, preferably 20 mm or less in thickness.

Superior flame resistance is obtained by using EPDM, chloroprene rubber, chlorosulfonated polyethylene, chlorinated polyethylene, hydrin rubber, silicone rubber or fluororubber, as the rubber-based elastic material. Even when a fire occurs after leaked hydrogen gas is mixed with oxygen in the air, the surface of the seal roll or the like is not burnt, melted or deteriorated until the fire is extinguished in a relatively short time by supplying nitrogen gas into the bright annealing furnace 21 or by spraying carbon dioxide gas from an extinguishing facility.

INDUSTRIAL USABILITY

In accordance with the invention, the boundary between the metal strip and the compartment casing is hermetically sealed by the elastic rolls, the rigid rolls and the elastic pushing members. Since the sliding contact between the elastic pushing member and the rigid roll is performed by the nonwoven fabric and the rigid material of the rigid roll having a smooth surface, the friction coefficient is small, and stable sealing performance can be obtained for an extended period of time without causing the fibers of the nonwoven fabric to fall out or without causing wear, thereby ensuring stable production activity for an extended period of time.

Furthermore, in accordance with the invention, in a continuous heat treatment furnace which uses an atmospheric gas including hydrogen gas, sealing in multiple steps can be easily offered, and sealing performance can be enhanced. Consequently, leakage of the atmospheric gas to the outside air is reduced, and the safety of operation can be enhanced. Gas and energy required for maintaining the atmospheric gas pressure and the vacuum can thus be reduced, thereby enhancing economy.

Furthermore, in accordance with the invention, a space is formed by the intermediate rolls and the additional elastic rolls outward from the elastic rolls. Therefore, the atmosphere in the space can be shut off more securely from the outside air.

Furthermore, in accordance with the invention, the space can be supplied with an inert gas or can be subjected to vacuum suction. The inner compartment can thus be shut off more securely from the outside air. When an inert gas is supplied, static electricity, if generated, can be neutralized by using an ion generator installed in the space, thereby ensuring safe sealing against fires.

Furthermore, in accordance with the invention, the various rubber materials of the elastic rolls or the additional elastic rolls are used as they are, or they are made conductive. By offering electrical conductivity, spark discharge due to static electricity hardly occurs. Even when a flammable gas leaks from the furnace, a disaster such as a fire hardly occurs. The safety of operation is thus enhanced.

Furthermore, in accordance with the invention, since a rubber layer having electrical conductivity is provided on the outer peripheral surface of the metal shaft or the metallic roll, spark discharge due to static electricity can be prevented while properly sealing the boundary between the metal strip and the elastic roll or the boundary between the rigid roll and the elastic roll.

Furthermore, in accordance with the invention, since the surface of the elastic pushing member has a covering layer (made of non-woven fabric) of 20 mm or less in thickness, no friction resistance is caused between the pushing member and the rigid roll. Superior sealing can thus be attained while reducing ventilation without the fear of deterioration, such as fiber falling. Consequently, the consumption of the atmospheric gas and the energy for maintaining the vacuum can be reduced.

Furthermore, in accordance with the invention, since the nonwoven fabric has an LOI value of 26 or more, even when a fire is caused by the leaked flammable atmospheric gas in the surrounding area, the self-extinguishing characteristic of the nonwoven fabric can prevent the fire from expanding, thereby enhancing the safety of operation and keeping fire damage to a minimum.

Furthermore, in accordance with the invention, since the hardness of the surface of the elastic pushing body is in the range of 10° to 50° specified in JIS S 6050, stable sealing performance can be delivered while maintaining an appropriate profiling performance for an extended period of time.

Furthermore, in accordance with the invention, since the electrical conductivity of the elastic roll or the elastic pushing body is offered by mixing carbon thereto, the mechanical characteristics, such as wear resistance, can also be enhanced, thereby being capable of delivering stable sealing performance for an extended period of time.

Furthermore, in accordance with the invention, since the elastic discs and the slip discs are interposed between the end face of the elastic roll in the axial direction thereof and the side wall, reliable hermetic sealing can be attained while the elastic roll is allowed to rotate, thereby being capable of offering an inexpensive sealing apparatus having a simple structure.

Furthermore, in accordance with the invention, since outer bearing and inner bearings are provided between the end face of the elastic roll in the axial direction thereof and the side wall as elastic roll end face sealing devices so as to prevent the rotation load from increasing, and members for enhancing the sealing performance are provided additionally, the rotation load can be reduced while the sealing performance is enhanced. Therefore, while saving the drive energy for rotation, the disturbance in tension at the metal strip or the like to be passed through in a compartment can be minimized, and the quality of products can be improved.

In consideration of these matters, since the invention can provide a sealing apparatus superior in economy, durability and safety, the industrial value of the invention is significant.

What is claimed is:

1. A sealing apparatus for sealing inlets/outlets of continuous heat treatment furnaces which use an atmospheric gas, continuous vacuum evaporation facilities which perform vacuum evaporation under reduced pressure, or the like, through which a metal strip is passed, or for sealing inlets/outlets of compartments of continuous heat treatment furnaces, continuous vacuum evaporation facilities or the like in which a pair of elastic rolls for sandwiching a metal strip is provided outward from an inlet and/outlet opening of a compartment, for passing the metal strip, to shut off the interior of the compartment from the exterior, the sealing apparatus comprising:

opposed side walls contacting the end faces of the pair of elastic rolls to ensure sealing;

a pair of rigid rolls hermetically contacting the pair of elastic rolls respectively with a clearance from the metal strip, between the opposed side walls; and elastic pushing members for hermetically sealing the boundary between each rigid roll and the furnace body or a compartment casing while contacting the rigid rolls.

2. The sealing apparatus for sealing inlets/outlets of compartments of continuous heat treatment furnaces, continuous vacuum evaporation facilities or the like, of claim 1, wherein the atmospheric gas includes hydrogen gas.

3. The sealing apparatus for inlets/outlets of compartments of continuous heat treatment furnaces, continuous vacuum evaporation facilities or the like, of claim 1, the sealing apparatus comprising:

a pair of additional elastic rolls for sandwiching the metal strip, which are disposed outward away from the pair of elastic rolls between the opposed side walls, and a pair of intermediate rolls disposed between the elastic rolls and the additional elastic rolls with a clearance from the metal strip, between the opposed side walls, the pair of intermediate rolls hermetically contacting the elastic rolls and the additional elastic rolls.

4. The sealing apparatus for inlets/outlets of compartments of continuous heat treatment furnaces, continuous vacuum evaporation facilities or the like, of claim 3, wherein means for supplying the atmospheric gas for an atmospheric heat treatment furnace, a gas similar to the atmospheric gas, nitrogen gas or an inert gas is provided in a space formed by being surrounded by the elastic rolls, the additional elastic rolls and the intermediate rolls, between the opposed side walls.

5. The sealing apparatus for inlets/outlets of compartments of continuous heat treatment furnaces, continuous vacuum evaporation facilities or the like, of claim 3, wherein means for supplying the atmospheric gas for an atmospheric heat treatment furnace, a gas similar to the atmospheric gas, nitrogen gas or an inert gas is provided in a space formed by being surrounded by the elastic rolls, the additional elastic rolls and the intermediate rolls, between the opposed side walls and wherein further an ion generator is installed in the space.

6. The sealing apparatus for inlets/outlets of compartments of continuous heat treatment furnaces, continuous vacuum evaporation facilities or the like, of claim 3, wherein a space formed by being surrounded by the elastic rolls, the additional elastic rolls and the intermediate rolls, between the opposed side walls is subjected to vacuum suction.

7. The sealing apparatus for inlets/outlets of compartments of continuous heat treatment furnaces, continuous vacuum evaporation facilities or the like, of claim 1 or 3, wherein the elastic rolls or the additional elastic rolls are made of an elastic body selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber, and hydrin rubber, leaving the specific electric resistance of the elastic body as it is, or providing the elastic body with electrical conductivity.

8. The sealing apparatus for inLets/outlets of compartments of continuous heat treatment furnaces, continuous vacuum evaporation facilities or the like, of claim 1 or 3, wherein the elastic rolls or the additional elastic rolls are integrally formed by cylindrically coating the over peripheral surfaces of metal shafts or metallic rolls with an elastic body selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber and hydrin rubber, in the longitudinal directions of the outer peripheral surfaces of metal shafts or metallic rolls, leaving the specific electric resistance of the elastic body as it is, or providing the elastic body with electrical conductivity; or the elastic rolls or the additional elastic rolls are integrally formed by mounting a cylindrical sleeve made of such elastic body on the outer peripheral surfaces of metal shafts or metallic rolls in the longitudinal directions thereof.

9. The sealing apparatus for inlets/outlets of compartments of continuous heat treatment furnaces, continuous vacuum evaporation facilities or the like, of claim 7, wherein the specific electric resistance of the elastic body of the elastic roll is in the range of 1 to $10^7$ Ω·cm.

10. The sealing apparatus for inlets/outlets of compartments of continuous heat treatment furnaces, continuous vacuum evaporation facilities or the like, of claim 7, wherein the hardness of the elastic body of the elastic roll is in the range of 40° to 90° specified in JIS K 6301 A.

11. The seating apparatus for inlets/outlets of compartments of continuous heat treatment furnaces, continuous vacuum evaporation facilities or the like, of claim 1 or 3, wherein the elastic pushing members are made of an elastic body selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber and hydrin rubber, or a sponge-like elastic body having minute cells made by foaming one kind of elastic body selected similarly, leaving the specific electric resistance of the selected elastic body as it is, or providing the selected elastic body with electrical conductivity to have a specific electric resistance in the range of 1 to $10^7$ Ω·cm.

12. The scaling apparatus for inlets/outlets of compartments of continuous heat treatment furnaces, continuous vacuum evaporation facilities or the like, of claim 11, wherein the elastic pushing member has a covering layer made of nonwoven fabric of 20 mm or less in thickness on the surface of the elastic body or the sponge-like elastic body.

13. The sealing apparatus for inlets/outlets of compartments of continuous heat treatment furnaces, continuous vacuum evaporation facilities or the like, of claim 12, wherein the nonwoven fabric of the elastic pushing member has a self-extinguishing characteristic at a limit oxygen index (LOI) value of 26 or more.

14. The seating apparatus for inlets/outlets of compartments of continuous heat treatment furnaces, continuous vacuum evaporation facilities or the like, of claim 11, wherein the hardness of the elastic body or the sponge-like elastic body of the elastic pushing member is in the range of 10° to 50° specified in JIS S 6050.

15. The sealing apparatus for inlets/outlets of compartments of continuous heat treatment furnaces, continuous vacuum evaporation facilities or the like, of claim 11, wherein the electrical conductivity of the elastic body of the elastic roll and the elastic pushing member or the electrical conductivity of the sponge-like elastic body of the elastic pushing member is provided by mixing carbon.

16. The sealing apparatus for the inlets/outlets of compartments of continuous heat treatment furnaces, continuous vacuum evaporation facilities or the like, of claim 1 or 3, wherein at both ends of the elastic roll in the axial direction thereof, elastic discs and slip discs are interposed between the end faces of the elastic roll and the side walls.

17. The sealing apparatus for inlets/outlets of compartments of continuous heat treatment furnaces, continuous vacuum evaporation facilities or the like, of claim 1 or 3, wherein the following are provided at both ends of the elastic roll in the axial direction thereof as members composing a sealing apparatus for sealing the ends of the elastic roll:

an outer covering member made of an elastic material, and having a first flange portion contacting the end face of the elastic roll and a first sleeve portion extending axially outward from the outer peripheral portion of the first flange portion;

a first supporting member made of a rigid material, and having a second flange portion contacting the outer surface of the first flange portion, outside in the axial direction from the first flange portion and a second sleeve portion extending axially outward from the outer peripheral portion of the second flange portion;

a second supporting member made of a rigid material, and having a third sleeve portion interposed between the shaft of the elastic roll and the second sleeve portion, outside in the axial direction from the second flange portion and a third flange portion extending in the radial direction of the elastic roll from the axially outward end face of the third sleeve portion:

an outer bearing interposed between the third sleeve portion and the second sleeve portion, and receiving radial and thrust forces;

inner bearings interposed between the third sleeve portion and the shaft of the elastic roll; and an end face sealing member interposed between the side wall and the third flange portion of the second supporting member, at least the outward side of the sealing member in the radial direction of the elastic roll being made of an elastic material.

18. The sealing apparatus for inlets/outlets of compartments of continuous heat treatment furnaces, continuous vacuum evaporation facilities or the like, of claim 1 or 3, wherein a surface of the rigid roll is a chrome-plated or tungsten carbide sprayed smooth layer, or is made of stainless steel.

19. The sealing apparatus for inlets/outlets of compartments of continuous heat treatment furnaces, continuous vacuum evaporation facilities or the like, of claim 8, wherein the specific electric resistance of the elastic body of the elastic roll is in the range of 1 to $10^7$ Ω·cm.

20. The sealing apparatus for inlets/outlets of compartments of continuous heat treatment furnaces, continuous vacuum evaporation facilities or the like, of claim 8, wherein the hardness of the elastic body of the elastic roll is in the range of 40° to 90° specified in JIS K 6301 A.

21. The sealing apparatus for inlets/outlets of compartments of continuous heat treatment furnaces, continuous vacuum evaporation facilities or the like, of claim 7, wherein the electrical conductivity of the elastic roll is provided by mixing carbon.

* * * * *